United States Patent [19]

Bossetti

[11] 4,201,542

[45] May 6, 1980

[54] OVEN FOR FIRING CERAMIC MATERIAL OR THE LIKE

[75] Inventor: Renato Bossetti, Novara, Italy

[73] Assignee: S.I.T.I. Societa Impianti Termoelettrici Industriali (s.a.s.), Marano Ticino, Italy

[21] Appl. No.: 917,648

[22] Filed: Jun. 21, 1978

[30] Foreign Application Priority Data

Jun. 30, 1977 [IT] Italy ..... 25229 A/77

[51] Int. Cl.[2] ..... F27B 9/02

[52] U.S. Cl. ..... 432/128; 432/75; 432/246; 99/446

[58] Field of Search ..... 432/75, 76, 261, 246, 432/230, 235, 236, 192, 143, 148, 153, 162, 168, 169, 137, 123, 126, 128, 121; 414/159; 99/386, 446, 443 C

[56] References Cited

U.S. PATENT DOCUMENTS

| | | | |
|---|---|---|---|
| 2,450,836 | 10/1948 | Levy et al. | 432/261 |
| 3,489,397 | 1/1970 | Alexander | 432/246 |
| 3,540,705 | 11/1970 | Hoffman | 432/236 |
| 3,659,517 | 5/1972 | Holen | 99/386 |
| 3,666,249 | 5/1972 | MacLeod, Jr. | 432/75 |
| 3,915,441 | 10/1975 | Matsukawa et al. | 432/235 |
| 3,989,028 | 11/1976 | Berger | 99/446 |
| 3,999,744 | 12/1976 | Kotch | 432/75 |

*Primary Examiner*—Henry C. Yuen

*Attorney, Agent, or Firm*—Wenderoth, Lind & Ponack

[57] ABSTRACT

An oven for firing ceramic materials which is provided with a firing chamber and with a plurality of rotatable transverse rollers for advancing the material to be fired along the chamber. The oven is provided with a horizontal auxiliary surface disposed in the lower part of the chamber, spaced from the material being fired, and with means for displacing the auxiliary surface longitudinally along the chamber in a direction opposite to the direction of travel of the material being fired. The vertical distance from the auxiliary surface to the roller axes is preferably not less than twice the axis-to-axis spacing between the rollers and not more than twice such roller spacing plus the diameter of the rollers. The speed of travel of the auxiliary surface is a submultiple of the speed of travel of the material being fired. The auxiliary surface is preferably constituted by a plurality of plates bearing on the oven floor and actuated for displacement in a preferably intermittent manner by thruster devices.

11 Claims, 6 Drawing Figures

OVEN FOR FIRING CERAMIC MATERIAL OR THE LIKE

BACKGROUND OF THE INVENTION

1. The Field of the Invention

The present invention relates to improvements in firing ovens for ceramic material for a refractory oven. Particularly, the invention refers to improvements in roller firing ovens for plate-like materials, in particular ceramic tiles, wherein the materials being fired travel along the oven because they bear on rotating rollers which impart thereto forward motion at a desired speed.

Such ovens may be constituted by a single channel or by one or more superimposed channels, and the invention is applicable in the same way to any number of channels, the only thing requirement being to multiply the same means required for a single channel.

Reference will be made in the description to an oven for firing ceramic tiles, though this does not constitute a necessary limitation. Since the invention is advantageously applicable to an oven of this kind, which forms the object of the copending application No. 27995 A/76, reference will be made in the present description specifically to an oven of such type, but this reference does not constitute a limitation as the invention is generally applicable to any roller oven for firing of materials having a plate-like configuration.

Ovens of such a type are schematically constituted by one or more channels, generally having a substantially rectangular cross-section, wherein rollers having their axes perpendicular to the longitudinal axis of the channel, i.e. to the direction of travel of the material being fired, are disposed at suitable intervals, such rollers being actuated for rotation by suitable mechanical drive means. The plate-like materials to be treated, in particular the tiles (to which reference will be made hereinafter for illustrative purposes) are laid onto the rollers at the channel inlet and are advanced thereby at a linear speed substantially equal to the peripheral speed of the rollers. The value of this speed is irrelevant to the invention, but generally, in modern ovens, may be in the order of one meter per minute or more. The heat required for the heating and firing of the tiles is communicated thereto in various ways depending on the oven, and in particular by convection, by radiation or by a combination of convection and radiation. The heating by radiation is effected by bringing the ceiling and the floor to a suitable temperature for directing radiation onto both faces of the tiles the walls also assuming high temperatures in order to maintain the thermal balance of the environment. The heating by convection is effected by introducing into the firing chamber, constituted by any one of the described channels, a hot gas, which may be any gas but is generally constituted by the combustion fumes of suitable burners mixed with excess air. The fumes may be introduced into the firing chamber in any suitable way, i.e. laterally or from the ceiling and/or the floor, or from all sides, and are generally possessed of a longitudinal flow along the firing chamber, generally countercurrent to the travel of the tiles.

In the oven described in earlier application No. 27995 A/76, the tile advancing rollers are not located on the center line of the vertical cross-section of the firing chamber but are shifted upwards with respect to such line, i.e. are closer to the ceiling than to the floor of the oven.

The invention will be described in its practical application to an oven having the aforesaid characteristics, but it is not limited thereby and would be applicable to a different roller oven as well.

2. The Prior Art

One of the most serious problems which arise in the industrial use of ovens of the type described, is constituted by the possibility, which it is impossible to entirely eliminate, of breakage of the pieces being fired, e.g. tiles. Such pieces when they break, give rise to fragments having dimensions such that they may pass between the advancing rollers and therefore they fall onto the oven floor. Further, detritus and dust originating from the fired material accumulate on such floor. Possible results may be, if the firing chamber is not periodically cleaned, obstructions in the firing chamber which produce even production stoppages, and a deterioration of the quality of the products due to the deposit thereon of the dust and the detritus set in motion by the gases flowing along the firing chamber.

To obviate these inconveniences, at least in part, it is necessary to periodically stop the oven and clean its floor, an operation that is not easy due to the considerable length of the firing chamber. In practice, however, even periodic cleanings, economically burdensome because of the labour required and especially because they interrupt the production, do not completely eliminate the obstruction of the firing chamber and the deterioration of the quality of the product. On the contrary, it often occurs that the necessity of cleaning the firing chamber before the moment planned in the production program, is made evident by the obstruction of the chamber itself and the fact that the pieces being fired do not advance regularly, with the result that the loss due to the production scrap thus generated is added to the cleaning costs.

All these inconveniences are eliminated by the present invention.

SUMMARY OF THE INVENTION

The improved oven according to the invention is characterized in that it comprises, in combination with at least one longitudinally extending firing chamber having a ceiling and a floor, and with a series of rollers disposed transversely of the firing chamber and actuated for rotation to advance the materials being fired along the chamber itself, an auxiliary horizontal surface disposed in the lower part of the chamber itself, spaced from the material being fired, and means for shifting such auxiliary surface longitudinally along the chamber in a direction opposite to the direction of travel of the material being fired.

According to a preferred characteristic of the invention, the vertical distance between the auxiliary surface and the roller axes is not less than twice the distance between adjacent roller axes.

According to another preferred characteristic, such vertical distance is not greater than twice the distance between adjacent roller axes plus the diameter of the rollers.

According to a further preferred characteristic, the mean speed of travel of the auxiliary surface is a submultiple of the speed of travel of the materials being fired.

The preferred ratio of the speed of the materials being fired to the mean travel speed of the auxiliary surface is greater than 200 and preferably comprised between 200 and 500.

According to another preferred characteristic of the invention, the auxiliary surface is constituted by a false floor, made up of a series of plate-like elements having a plane upper surface, directly bearing on the floor of the oven or of the channel thereof which is being considered.

According to another preferred characteristic of the invention, the means for advancing the auxiliary surface along the firing chamber, are constituted by thrust elements which act on the elements which constitute the surface in the vicinity of the firing oven inlet opening, the advancing thrust being then transmitted by the elements on which the thrust elements act, to other successive elements in successive contact the ones with the others.

Preferably the thrust elements operate discontinuously, their actuating stroke being equal to the length of each of the elements.

Still more preferably, the elements bear on the oven floor through longitudinal ribs.

According to a further preferred characteristic of the invention, when the oven is heated by convection, the auxiliary surface is provided with opening for the passage of the heating gases.

BRIEF DESCRIPTION OF THE DRAWINGS

The invention will now be better understood from the following description of a non-limitative embodiment thereof, with reference to the attached drawings wherein.

DETAILED DESCRIPTION OF THE INVENTION

Figure 1:
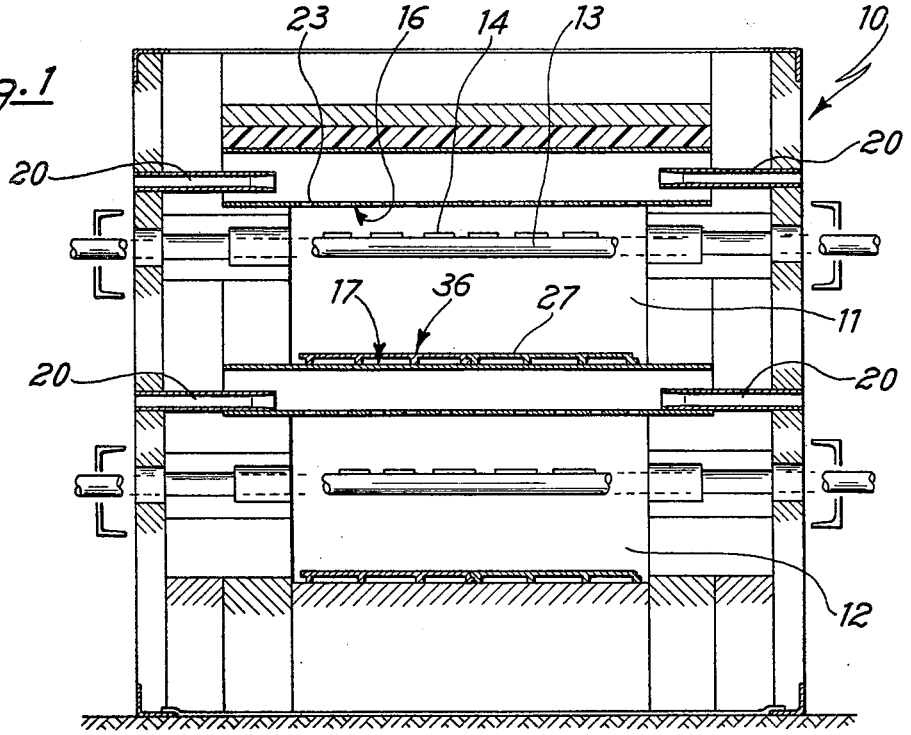
FIG. 1 is a transverse cross-section of an oven to which an embodiment of the present invention has been applied.

With reference first of all to FIG. 1, the oven illustrated therein is an oven including two superimposed channels, as in the cited copending application. However, the invention could be applied to an oven having three or more superimposed channels, to an oven having two or more channels laterally disposed side by side on one or more vertical planes, as well as to an oven having only one channel.

At any rate, in the example illustrated in FIG. 1, the oven comprises a brickwork structure generally indicated at 10, wherein there are defined the two superimposed channels 11 and 12. In each channel rollers 13 are transversely disposed, on which the tiles 14 to be fired may be laid, only a few of such tiles being shown by way of partial illustration. The oven is provided with a ceiling 16 and a floor 17. The heating of the tiles occurs mainly by convection through the fumes produced by burners 20 disposed laterally of the firing channels. In the embodiment illustrated, the burners 20 convey their fumes into gaps located above the ceiling and below the floor of each channel, the gaps intermediate between the two channels being obviously concurrently below the floor of the overlying channel and above the ceiling of the underlying channel.

The fumes penetrate into the two channels through apertures 23 opened in the ceiling and apertures in the floor of each channel. The heating also, however, could be effected differently than as illustrated.

Figure 2:
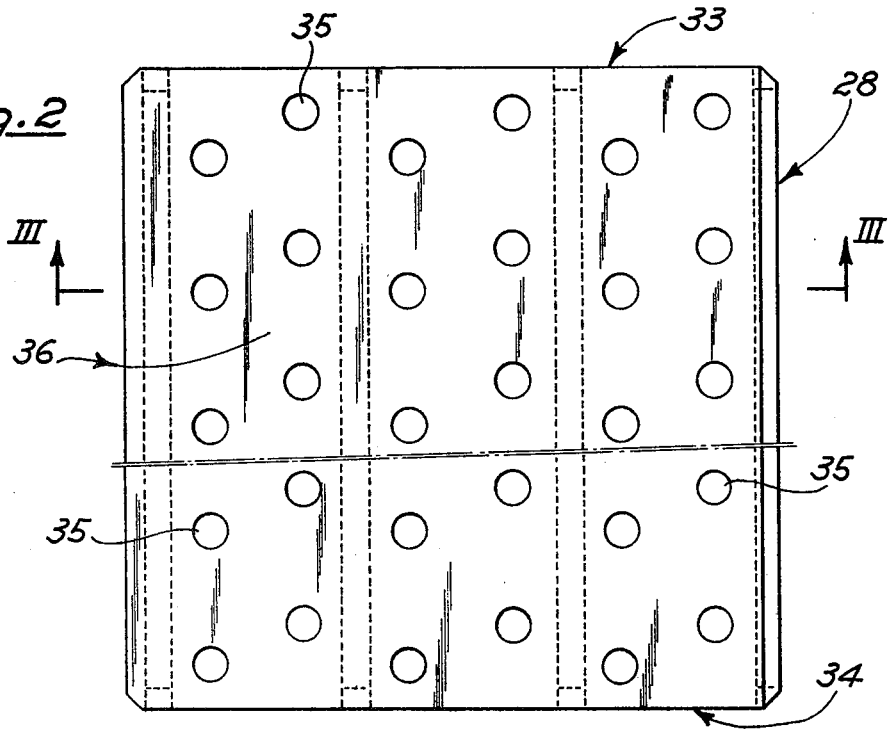
FIG. 2 is a plan view of a portion of the auxiliary surface according to an embodiment of the present invention.
Figure 3:
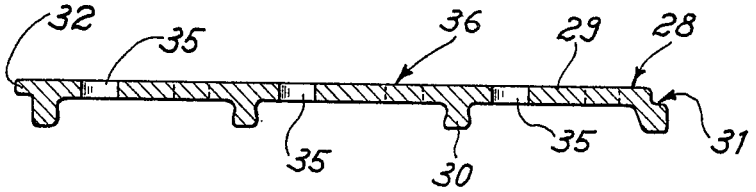
FIG. 3 is a transverse cross-section of the structure of FIG. 2, taken on the line III—III of FIG. 2, viewed in the direction of the arrows.
Figure 4:
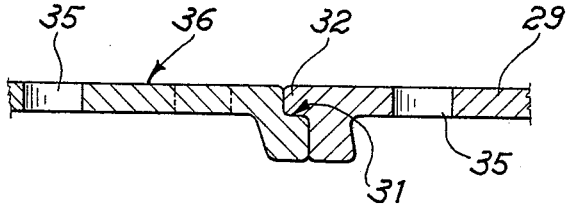
FIG. 4 is a detail at an enlarged scale, in cross-section as in FIG. 3, illustrating a joint of the auxiliary surface.

Above the floor 17 of each channel, according to the invention, a false floor is disposed which constitutes the auxiliary surface and which is embodied by a layer of refractory plates collectively indicated at 27. Such elements could have greatly different dimensions and configurations, but in the embodiment illustrated they are shaped as shown in FIGS. 2 and 3, wherein one of such plates is shown. Such plate is indicated generally at 28, is constituted by a plane portion 29 and by a number of ribs 30 protruding from its bottom. Further the plate itself is provided on one side with a groove or longitudinal recess 31 and on an opposite side with a projection or longitudinal shoulder 32, the recess 31 and the shoulder 32 having complementary shapes and dimensions, so that the shoulder 32 of one plate may penetrate into the recess 31 of another adjacent plate to make up a substantially continuous layer which is the false floor, i.e. the auxiliary surface provided by the invention, as is particularly shown in FIG. 4. The other two sides (33 and 34) which are disposed transversely with respect to the firing chamber when the plates are inserted thereinto, are preferably perfectly plane and squared off (with small connecting portions, see FIG. 2) so that when a number of plates bear on the floor 17 of the firing chamber in mutual contact, the adjacent sides 33 of one plate and 34 of the successive plate are adapted to transmit from the one to the other plate the thrust for advancing the false floor.

The plates described are made of a suitable refractory material and are preferably provided with bores 35, which bores are necessary when it is necessary and desirable to permit the passage of hot fumes from the floor 17 to the space overlying it in the firing chamber, whereby the fumes come into contact with the tiles being fired.

According to a preferred characteristic of the invention, the distance between the upper surface 36 of the plates as described and the roller axes is not less than twice the rollers axis-to-axis spacing between the and still more preferably it is not more than twice such spacing plus the diameter of the rollers. The distance of the roller axes from the ceiling 16 of the firing chamber is irrelevant to the ends of the invention, but may preferably be less than the aforesaid distance from the plates and may be comprised between this latter and the roller spacing.

Figure 5:
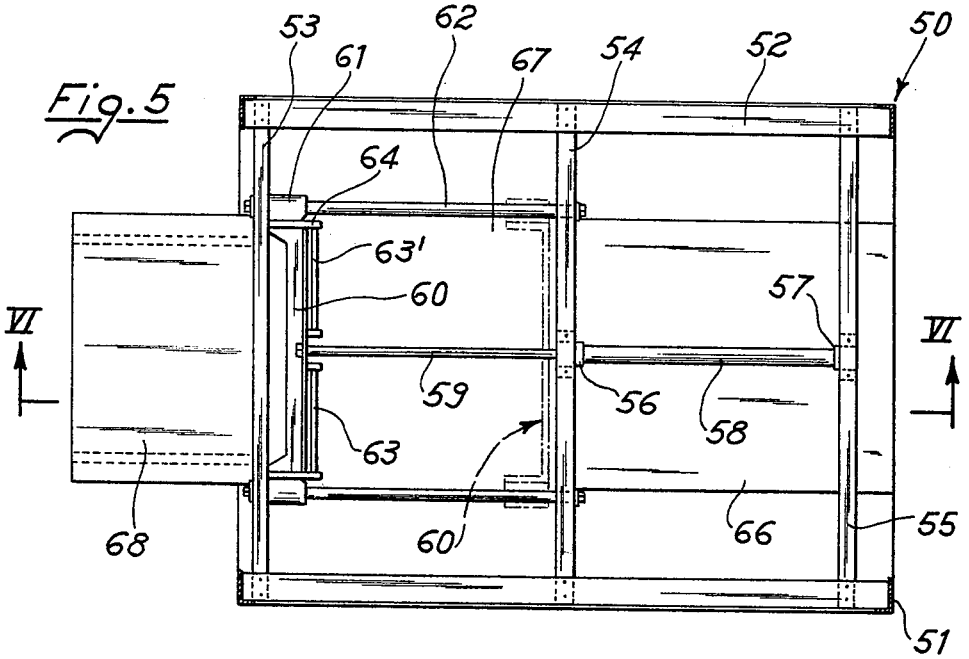
FIG. 5 is a plan view of an embodiment of thrust means.
Figure 6:
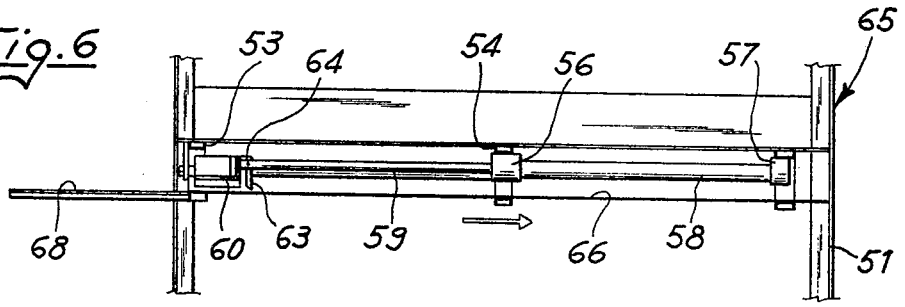
FIG. 6 is a cross-section taken along line VI—VI of FIG. 5.

FIGS. 5 and 6 illustrate a mechanism adapted to produce the desired translation of the plates which constitute the false floor of a channel, along the channel itself, but it is clear that this is only an illustrative example as the invention does not depend on the particular type of mechanism employed to displace the false floor and a great variety of mechanisms could be adapted to this end.

The thrust device illustrated, which is placed outside the oven and before the outlet opening of the tiles (generally a cooling zone) comprises any framework generally indicated at 50 and comprising e.g. uprights 51 and beams 52, and which also comprises, or to which are rigidly connected, crossbeams indicated at 53, 54 and 55. The cylinder 58 of a hydraulic thrust device fed with a fluid in any convenient manner, not illustrated, is attached to the crossbeams 54 and 55 by means of supports 56 and 57. The fluid actuates piston rod 59 for alternating motion, and a head 60, connected to sleeves 61 slidable on guide rods 62 fixed to the crossbeams 53 and 54 and carrying a double thrust rod 63–63′ hinged at 64 and which may rotate only in one direction—counterclockwise as seen in FIG. 6—is fixed in forwardly position to piston rod 59.

The plane 66 is located at the level of the channel floor of the oven, onto which the plates 27 must be fed. The plates themselves are manually or automatically loaded by introducing them from platform 68 and shifting them to the right as seen in FIG. 5, bringing them into the space indicated at 67 which stands before the rearmost position of the head 60 (illustrated in the drawings) and behind the foremost position thereof, shown in broken lines in FIG. 5. In the motion in the direction of the arrow in FIG. 6, the plates move beyond the double rod 63–63′, causing it to rotate, and below the remaining part of the head. At the desired moment, the rod 59 is urged in the direction of the arrow and the double rod 63–63′ displaces the tiles all the way to the oven mouth or more precisely its outlet opening—which is adjacent to the end 65 of the device. The stroke of the thrust device is slightly greater than the length of one plate.

Obviously the thrust device described is not a part of the invention and may be constituted by any other known thrust device or any such device which a person skilled in the art may make. What is necessary is that it be adapted to advance, continuously or discontinuously, the plates which constitute the oven false floor, in the desired direction and with the desired speed. The direction is—as has been already pointed out—opposite to the direction of travel of the tiles, or other ceramic material being fired, so that the plates are added in front of the oven outlet opening and when they have gone through the oven itself, are collected in front of the inlet opening thereof to be recycled. A suitable collection platform is disposed in front of the oven inlet opening, but it is not necessary to describe it as it is an obvious and easily designed element. From the collection platform the plates are manually or mechanically removed, are freed from pieces of material which may have deposited thereon, and cleaned and recycled.

The speed with which the false floor advances may vary within very wide limits. Preferably in regime conditions such speed is about from 1 to 6 meters per hour and is such that the ratio of the contrary travel speed of the tiles or other material being fired and the translation speed of the false floor, is comprised between 200 and 500, but it may be even much higher. Further it is desirable that the speed may be variable, and e.g. may be increased even considerably under emergency conditions or when it is necessary to rapidly remove exceptionally high amounts of scrap fallen onto the false floor.

The dimensions of plates 27 may vary within wide limits, generally it is preferable that their width be in the order of one half or one third of the width of the oven channel, since an excessive number of plates arranged side by side may cause a certain instability of the false floor, but in the case of exceptionally narrow channels they could be as broad as the channel. This naturally depends on the width of the oven channel as well, since considerations of the mechanical strength and manufacturing problems place limits on the dimensions which may be attributed to the individual plates. The length of the plates is also widely variable, and the limitations of mechanical strength and manufacturing problems are valid in this connection too.

In principle, any length of the plate is acceptable, provided that it is suitably coordinated with the dimensions of the thruster or other mechanism which produces the translatory motion of the false floor.

It should be noted that it is foreseen that the false floor may be kept motionless, even through periods of a number of hours, when the oven operation permits this.

In the embodiment illustrated, the plates have been indicated as being perforated inasmuch as it has been assumed that they are used in an oven such as that illustrated in FIG. 1, wherein the heating takes place prevalently by convection and consequently there are heating gases or fumes—in general combustion fumes—which must flow out of the oven floor and pass through the false floor to heat the lower surface of the tiles. However were there no such gases, as e.g. when electric heating is used, then the plates are not necessarily perforated. It is to be noted that in such a case they would be overturned, i.e. would have the ribs upwardly disposed towards the rollers so as to increase the radiating surface, and would become heated by contact with the oven floor and would in turn heat the overlying tiles by radiation. Although the false floor bears on the floor through its ribs, since it is in a space which is saturated with thermal radiation and in which all the parts are in thermal equilibrium, it rapidly attains a temperature close to that of the floor, and anyway the heating of the oven is suitably controlled in such a way as to bring the surface of the false floor to the desired temperature within the desired time, whereby the surface becomes the radiating surface which heats the lower surface of the tiles.

An embodiment of the invention has been illustrated wherein all the elements which make up the false floor slide with sliding friction on the true oven floor. Rotating elements, such as free or actuated rollers, could also be provided to reduce or practically to eliminate the friction of the false floor with the oven floor, but it is preferred not to use devices of this kind in view of the complication they cause, also taking into account that they must operate in a space at high temperature, which in a zone of the oven significantly exceeds 1000° C.

As has been observed, although the application of the invention to a particular type of oven has been described, it is in general applicable to all roller type ovens, wherein the tiles and other elements or other materials to be fired advance on a plurality of transverse oven rollers rotating with a suitable speed, on condition that the characteristic conditions of the invention are maintained.

I claim:

1. An improved oven for firing ceramic material or the like, said oven comprising:

at least one longitudinally extending firing chamber having a ceiling and a floor;

a plurality of rollers disposed transversely of said firing chamber and actuated for rotation to advance material to be fired longitudinally along said chamber;

a horizontal auxiliary surface disposed within a lower part of said chamber at a position spaced from the material being fired; and means for displacing said auxiliary surface longitudinally along said chamber in a direction opposite to the direction of travel of the material being fired.

2. An improved oven as claimed in claim 1, wherein the vertical distance from said auxiliary surface to axes of said rollers is not less than twice the distance between axes of adjacent said rollers.

3. An improved oven as claimed in claim 2, wherein said vertical distance is not greater than twice said distance between axes of adjacent said rollers plus the diameter of said rollers.

4. An improved oven as claimed in claim 1, wherein the average speed of travel of said auxiliary surface is a submultiple of the speed of travel of the material being fired.

5. An improved oven as claimed in claim 4, wherein the ratio of the speed of the material being fired to said average speed of travel of said auxiliary surface is more than 200, and preferably comprised between 200 and 500.

6. An improved oven as claimed in claim 1, wherein said auxiliary surface comprises a false floor constituted by a plurality of plate-like elements having a plane upper surface, and directly bearing on said oven firing chamber.

7. An improved oven as claimed in claim 6, wherein said means for displacing said auxiliary surface along said firing chamber comprises thrusters which act on said elements in the vicinity of an outlet opening of said firing chamber, advancing thrust then being transmitted by the said elements on which said thrusters act to successive said elements in successive contact with one another.

8. An improved oven as claimed in claim 7, wherein said thrusters include means acting discontinuously at predetermined intervals and having an advancing stroke equal to or slightly less than the length of each of said elements.

9. An improved oven as claimed in claim 6, wherein said plate-like elements have longitudinal ribs which bear on said chamber floor.

10. An improved oven as claimed in claim 6, wherein said plate-like elements each have a plane surface which bears on said chamber floor.

11. An improved oven as claimed in claim 1, wherein said oven is heated by convection, and said auxiliary surface is provided with apertures for the passage therethrough of heating gases.

* * * * *